US005276420A

United States Patent [19]

Dufrene et al.

[11] Patent Number: 5,276,420

[45] Date of Patent: Jan. 4, 1994

[54] ELECTROMAGNETIC ACTUATING DEVICE INCORPORATED IN A REMOTE CONTROL UNIT

[75] Inventors: Daniel Dufrene, Meylan; Alain Frolla, Brignoud; Olivier Dardare, Givry, all of France

[73] Assignee: Merlin Gerin, France

[21] Appl. No.: 973,755

[22] Filed: Nov. 9, 1992

[30] Foreign Application Priority Data

Nov. 22, 1991 [FR] France ..... 91 14754

[51] Int. Cl.[5] ..... H01F 7/18; H01H 51/00

[52] U.S. Cl. ..... 335/242; 335/76; 335/77

[58] Field of Search ..... 335/242, 76, 77, 60, 335/63, 64, 65, 239, 253

[56] References Cited

FOREIGN PATENT DOCUMENTS 2161011 6/1973 Fed. Rep. of Germany .
2559616 8/1985 France .
2567317 1/1986 France .

*Primary Examiner*—Harold Broome
*Attorney, Agent, or Firm*—Parkhurst, Wendel & Rossi

[57] ABSTRACT

An electromagnetic actuator comprises a coil associated with a magnetic circuit having a first series of polar parts to drive a rotor, and a second series of polar parts cooperating with a pivoting blade. A return spring causes movement of the blade to a separated position. A latch is rendered active to lock the blade in the separated position during rotation of the rotor, and inactive to unlock the blade enabling its electromagnetic attraction against the polar face, and stopping of the rotor. The actuator has an operating mode either as motor or as electromagnet depending on the position of the blade.

9 Claims, 3 Drawing Sheets

ELECTROMAGNETIC ACTUATING DEVICE INCORPORATED IN A REMOTE CONTROL UNIT

BACKGROUND OF THE INVENTION

The invention relates to an electromagnetic actuating device, notably incorporated in a remote control unit, comprising an excitation coil associated with a magnetic circuit.

A first type of electromagnet actuator used in circuit breaker opening and/or closing remote control units is formed by at least one electromagnet, described as an example in the documents FR-A-2,559,616 and 2,567,317. The mechanical energy for closing provided by a plunger electromagnet when excitation of the coil takes place is relatively limited, for a predetermined size, and is not suitable for driving high-speed closing circuit breaker mechanisms, associated with control auxiliaries. Moreover, remote controlled opening is performed by means of a small opening electromagnet which sends a tripping order to the circuit breaker. The opening energy is thus generated by the accumulation spring of the main mechanism of the circuit breaker, and the opening electromagnet of the remote control unit acts as a simple shunt trip coil or other tripping auxiliary.

A second type of electromagnetic actuator for a remote control unit uses a rotary electric motor associated with a speed reducer mechanism to perform the two operations of opening and closing of the circuit breaker. The motor is generally controlled by an electric circuit with three wires and two buttons for on-off control, and end-of-travel contacts cause interruption of excitation of the motor after each operation. Such a device is very complicated and requires large overall dimensions.

The object of the invention consists in simplifying operation of an electromagnetic actuating device for a remote control unit with accumulation of opening energy.

SUMMARY OF THE INVENTION

The electromagnetic actuating device, according to the invention is characterized in that:

- the magnetic circuit comprises a first series of polar parts bounding a first air-gap for driving in rotation of a rotor equipped with an operating shaft, and a second series of polar parts cooperating with a mobile blade made of ferromagnetic material, capable of occupying a separated position with formation of a second air-gap, and an attracted position,
- a return spring causing movement of the blade from the attracted position to the separated position when excitation of the coil is interrupted,
- and a latch designed to perform locking of the blade in the separated position during the power supply phase of the coil, and the rotation phase of the rotor, releasing of the blade by unlocking of the latch then causing electromagnetic attraction of the blade against the polar faces of the second series, and automatic stopping of the rotor.

In the separated position of the blade, the actuating device has an operating mode as a motor, since most of the magnetic flux following excitation of the coil passes through the rotor.

In the attracted position of the blade after unlocking of the latch, the actuating device acts as an electromagnet. Most of the magnetic flux then passes through the blade, causing the motor to be switched out of operation.

The magnetic circuit and coil constitute a common assembly for both these operating modes as motor and as electromagnet. The reluctance of the magnetic circuit is variable depending on the operating mode, and a small amount of energy is sufficient to maintain the blade in the attracted position. To release the blade, excitation of the coil merely has to be interrupted.

According to one feature of the invention, the rotor shaft is mechanically coupled to a speed reducer associated with an operating mechanism for loading of an energy accumulation spring, and for driving of a handle.

Unlocking of the latch of the blade is performed automatically at the end of loading of the accumulation spring by the action of a first operating link associated with the mechanism. The blade is moreover connected to a latching device by means of a second operating link to maintain the accumulation spring in the loaded state when the blade is in the attracted position. Relaxation of the accumulation spring takes place after excitation of the coil has been interrupted, making the blade move from the attracted position to the separated position.

According to another feature of the invention, the handle of the remote control unit is mechanically coupled to the manual operating device for closing and opening of an adjoined circuit breaker unit, to bring about closing of the contacts of the circuit breaker unit in the course of loading of the accumulation spring resulting from the rotation movement of the rotor in the separated position of the blade, and opening of the contacts due to the relaxation action of the spring resulting from interruption of excitation of the coil.

The mechanism comprises a mechanical transmission link coupled to the handle, and a mechanical loading link cooperating with the latching device and with one of the strands of the accumulation spring.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
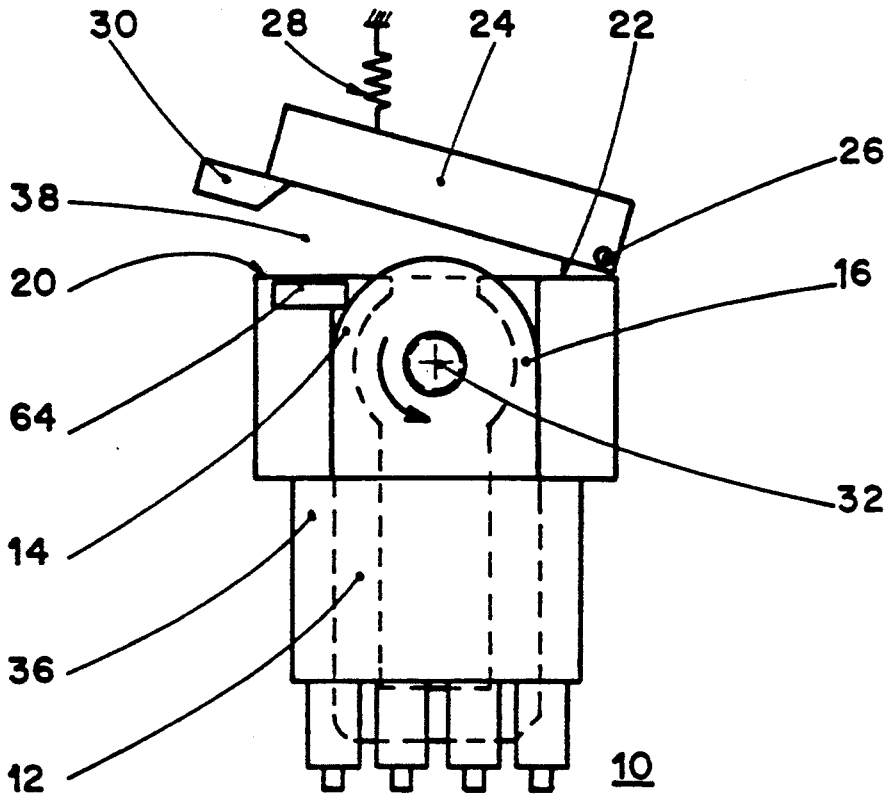
FIGS. 1 and 2 are schematic views of the actuating device according to the invention, operating respectively as motor and as electromagnet.

Referring to FIGS. 1 to 5, an electromagnetic actuating device 10 comprises a fixed U-shaped magnetic circuit 12 having a first pair of polar parts 14,16 between which a rotor 18 is located, and a second pair of polar parts 20,22 cooperating with a blade 24 made of ferromagnetic material, which is pivotally mounted on a spindle 26. A return spring 28 biases the blade 24 to a separated position (FIG. 1), and a latch 30 is designed to keep the blade 24 locked in the separated position.

The rotary shaft 32 of the rotor 18 extends parallel to the articulation spindle 26 of the blade 24, and a first radial air-gap 34 (FIG. 2) is arranged between the rotor 18 and the two polar parts 14, 16. An excitation coil 36 or winding is mounted on the magnetic circuit 12 to generate an induction flux passing through the radial air-gap 34, and a magnetic attraction flux in a second air-gap 38 arranged between the polar face 20 and the blade 24.

The actuating device 10 is advantageously used in a remote control unit 40 designed to be adjoined to a circuit breaker unit 42 (FIG. 4) to perform automatic opening and closing of the contacts of the circuit breaker unit. Inside the insulating case 44 of the remote control unit 40 (FIG. 5) there is located a speed reducer 46 driven by the shaft 32 of the rotor 18. The output of the speed reducer 46 is coupled to a cam mechanism 48, having a mechanical transmission link 50 with a drive handle 52, and a mechanical loading link 54 with an energy accumulation spring 56.

The handle 52 protrudes out from the remote control unit 40, and is permanently coupled with the manual operating device of the circuit breaker unit 42. Between the blade 24 and mechanism 48 there re in addition located a first operating link 58 of the latch 30 associated with the blade 24, and a second operating link 60 of a latching device 62 cooperating with the mechanical loading link 54 to keep the spring 56 loaded when the rotor 18 stops. One of the strands of the energy accumulation spring 56 is driven in rotation by a pin of the mechanical loading link 54, and the other strand bears on a stop 66.

The polar part 20 of the magnetic circuit 12 is equipped with a Frager ring or coil 64 to achieve the phase shift of the second magnetic flux with respect to the excitation current of the coil 36, thereby preventing any vibration when the blade 24 is attracted after the latch 30 has been unlocked.

Operation of the actuating device 10 of the remote control unit 40 is as follows:

In FIG. 1, the latch 30 ensures positive locking of the blade 24 in the separated position. Almost all the magnetic flux generated by excitation of the coil 36 passes through the polar parts 14,16, radial air-gap 34 and rotor 18, and causes rotation of the rotor 18. The latching device 62 is in the inactive position, and enables the spring 56 to be loaded via the reducer 46 and the mechanical link 54 of the mechanism 48. The latter simultaneously transmits a closing operation to the handle 52 via the mechanical transmission link 50. This results in closing of the contacts of the circuit breaker unit 42 during the loading phase of the spring 56. During this phase of operation, the actuating device 10 behaves as an asynchronous or synchronous single-phase motor. The energy stored in the spring 56 will subsequently be used for opening of the contacts of the circuit breaker unit 42.

Figure 2:
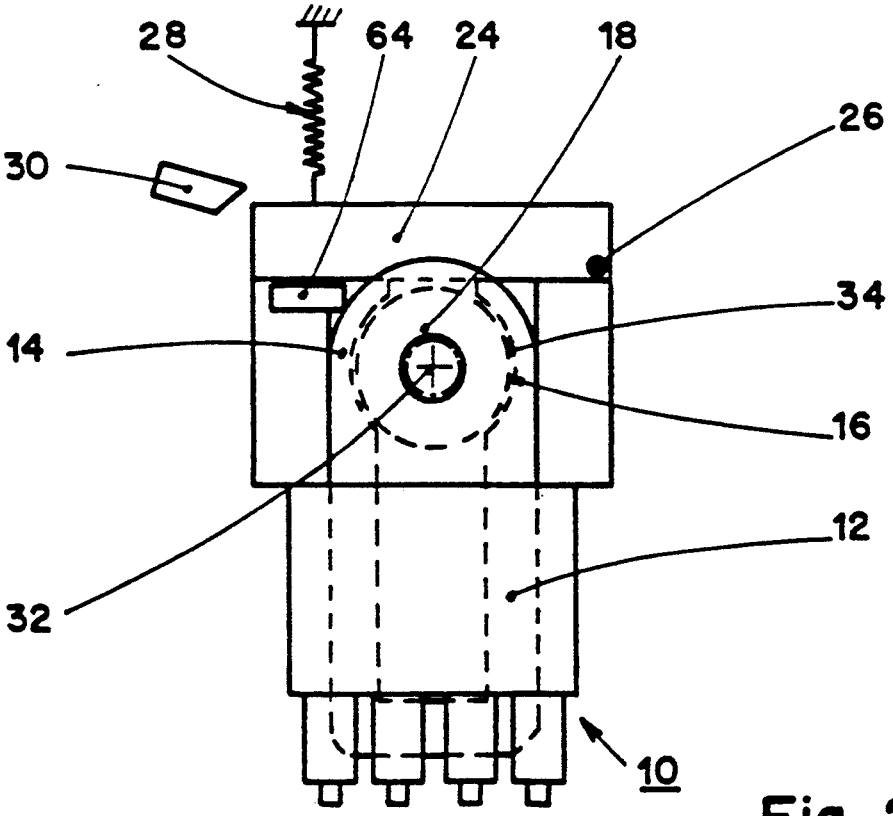
Figure 3:
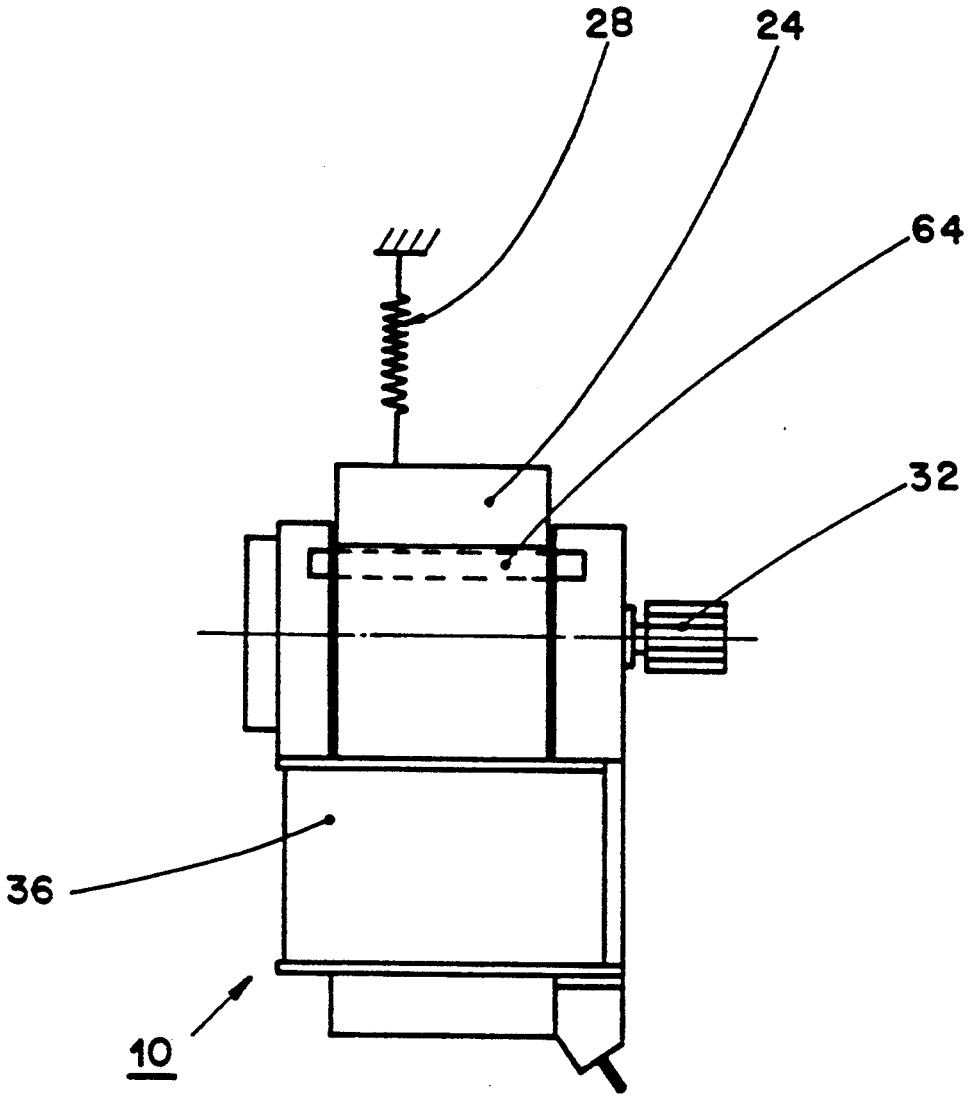
FIG. 3 shows a side view of FIG. 2.
Figure 4:
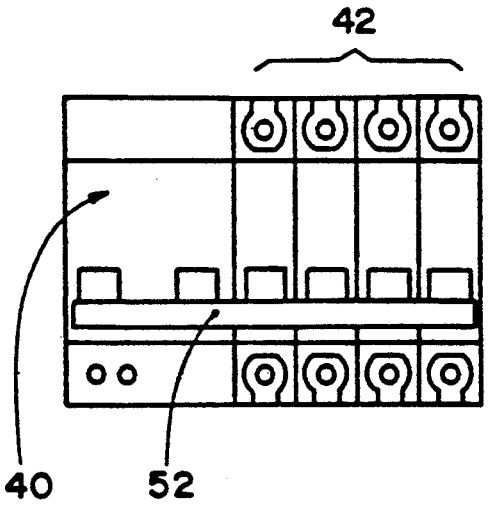
FIG. 4 represents an assembly of a circuit breaker unit and of a remote control unit.
Figure 5:
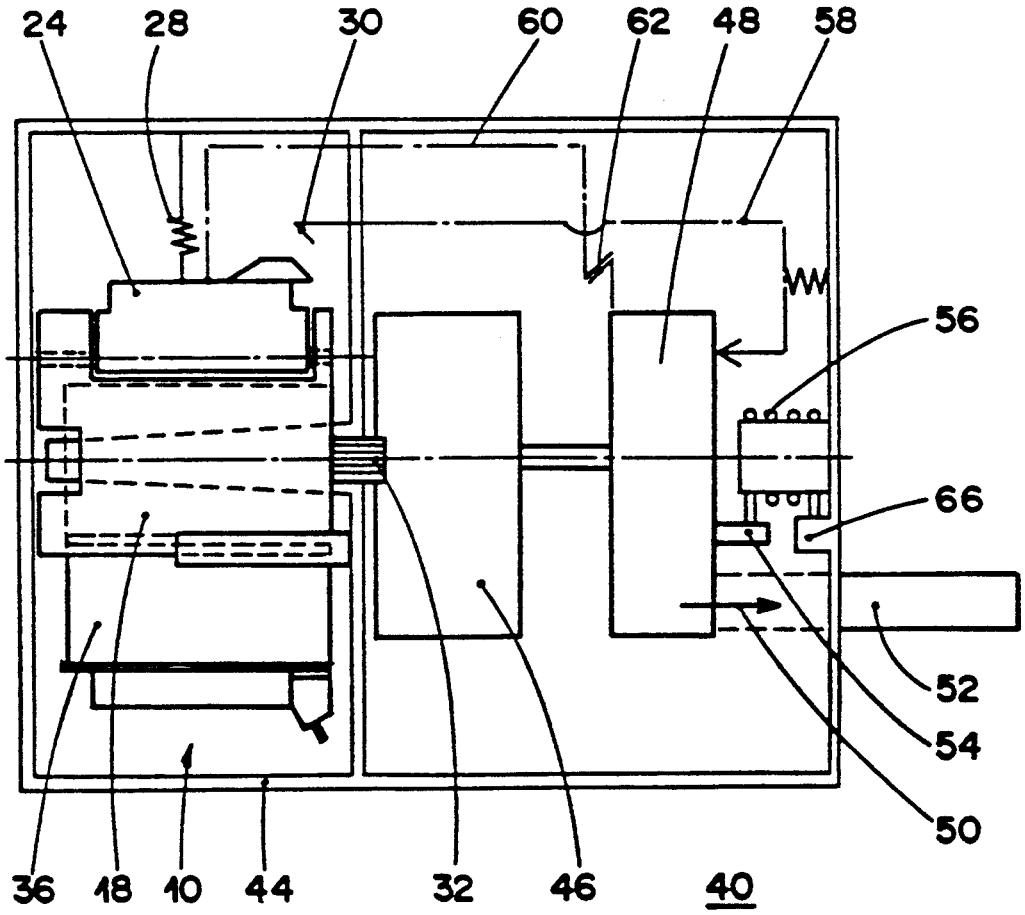
FIG. 5 is a schematic view of the remote control unit, the blade of the actuating device being represented in the attracted position.

At the end of the loading travel of the spring 56, the first operating link 58 causes the latch 30 to retract so as to release the blade 24. The coil 36 remains supplied, and the magnetic attraction flux in the second air-gap 38 is sufficient to attract the blade 24 up against the polar face 20 against the return force of the spring 28 (FIG. 2). At this moment, the reluctance of the magnetic circuit through the blade 24 is lower than that imposed by the first radial air-gap 34 of the rotor 18. Most of the magnetic flux then loops via the blade 24 causing the rotor 18 to stop. The attracted position of the blade 24 (FIG. 2) is stable so long as excitation of the coil 36 is maintained. The second operating link 60 moves the latching device 62 to the active position, so as to lock the accumulation spring 56 in the loaded position, as soon as the rotor 18 stops. A small amount of energy is required to keep the blade 24 in the attracted position.

To perform opening of the contacts of the circuit breaker unit 42 by means of the handle 52 of the remote control unit 40, the power supply to the coil 36 has to be interrupted. The magnetic flux attracting the blade 24 against the polar face 20 disappears, and the return spring 28 ensures pivoting of the blade 24 to the separated position. The separation action of the blade 24 on the second operating link 60 causes the latching device 62 to be moved to an inactive position, enabling the relaxation of the accumulation spring 56. The energy restored by this spring 56 is transmitted to the mechanism 48 and handle 52 to bring about opening of the circuit breaker unit 42.

In the open position of the circuit breaker unit 42, the accumulation spring 56 is not loaded, and the latch 30 maintains the blade 24 in the separated position. Reloading of the spring 56 takes place when the circuit breaker unit 42 is reclosed by excitation of the coil 36 of the remote control unit 40.

It can be noted that the operating mode of the actuating unit 10 as a motor ceases as soon as the circuit breaker unit 42 has closed. As soon as the end of loading travel of the accumulation spring 56 is reached, the actuating unit 10 acts as an operating electromagnet with the same coil 36 as that used for the operating mode as a motor.

According to a development of the invention, automatic stopping of the rotor 18 after unlocking of the latch 30 can be controlled by additional braking means (not represented). A mechanical brake can be associated with the shaft of the rotor 18 to stop rotation of the motor as soon as the blade 24 is attracted. It is also possible to choose electrical braking by injecting a D.C. or rectified current, or by connecting a series impedance in the power supply circuit of the coil 36.

We claim:

1. An electromagnetic actuating device incorporated in a remote control unit, comprising:

a fixed magnetic circuit provided with a first series of polar parts, and a second series of polar parts, a rotatable rotor equipped with an operating shaft, said rotor being surrounded by said first series of polar parts, a first air-gap located between said rotor and said first series of polar parts, a blade made of ferromagnetic material, and being movable with respect to said second series of polar parts between a separated position and an attracted position, a second air-gap arranged between the blade and the second series of polar parts when said blade is in the separated position, a winding mounted upon said magnetic circuit to generate upon excitation a first induction flux passing through said first air-gap, and a second attraction flux passing through said second air-gap, a spring biasing said blade towards the separate position when excitation of the coil is interrupted, latch means for keeping said blade locked tin the separated position upon rotation of the rotor, releasing means cooperating with said latch means so as to cause said blade to move towards the attracted position by the action of the second attraction flux, said rotor being stopped automatically when said blade comes into engagement with the second series of polar parts.

2. The actuating device according to claim 1, wherein the blade is pivotally mounted on a spindle of the magnetic circuit, said operating shaft extend parallel to said spindle.

3. The actuating device according to claim 1, wherein said operating shaft is mechanically coupled to a speed reducer associated with an operating mechanism for loading of an energy accumulation spring, and for driving of a handle.

4. The actuating device according to claim 3, wherein said latch means is connected to the mechanism by a first operating link to bring about unlocking of said blade at the end of loading of the accumulation spring.

5. The actuating device according to claim 4, wherein said mechanism comprises a latching device controlled by a second operating link fixedly secured to the blade, the latching device being either active in the attracted position of the blade, enabling the accumulation spring to be maintained in the loaded state as soon as the rotor stops, or inactive when movement of the blade takes place to the separated position enabling relaxation of the spring.

6. The actuating device according to claim 5, wherein said handle is mechanically coupled to a manual operating device for closing and opening of an adjoined circuit breaker unit, to bring about closing of the circuit breaker unit contacts in the course of loading of the accumulation spring resulting from the rotation movement of the rotor in the separated position of the blade, and opening of the contacts due to the relaxation action of the spring resulting from the interruption of excitation of the coil.

7. The actuating device according to claim 5, wherein said mechanism comprises a mechanical transmission link coupled to the handle, and a mechanical loading link cooperating with said latching device and with one of the strands of the accumulation spring.

8. The actuating device according to claim 2, wherein a polar face situated opposite the second air-gap is provided with a phase displacement ring to prevent vibrations when the blade is attracted.

9. The actuating device according to claim 1, wherein said winding the magnetic circuit is supplied with alternating current.

* * * * *